US012104612B1

(12) United States Patent
Purdy et al.

(10) Patent No.: US 12,104,612 B1
(45) Date of Patent: Oct. 1, 2024

(54) SYSTEMS AND METHODS FOR MAINTAINING THE PRIME OF A PUMP

(71) Applicant: Purdy Enterprises Inc., Boise, ID (US)

(72) Inventors: Nicholas R Purdy, Boise, ID (US); Logan B. Thompson, Caldwell, ID (US)

(73) Assignee: Purdy Enterprises Inc., Boise, ID (US)

( * ) Notice: Subject to any disclaimer, the term of this patent is extended or adjusted under 35 U.S.C. 154(b) by 0 days.

(21) Appl. No.: 18/499,790

(22) Filed: May 6, 2024

(51) Int. Cl.

| | |
|---|---|
| ***F04D 27/02*** | (2006.01) |
| ***F04B 49/02*** | (2006.01) |
| ***F04B 49/035*** | (2006.01) |
| ***F04B 49/06*** | (2006.01) |
| ***F04B 49/22*** | (2006.01) |
| ***F04B 49/24*** | (2006.01) |
| ***F04D 9/00*** | (2006.01) |
| ***F04D 9/02*** | (2006.01) |
| ***F04D 13/12*** | (2006.01) |
| ***F04D 15/00*** | (2006.01) |
| ***F04D 27/00*** | (2006.01) |

(52) U.S. Cl.
CPC ..... *F04D 27/0207* (2013.01); *F04B 49/02* (2013.01); *F04B 49/035* (2013.01); *F04B 49/06* (2013.01); *F04B 49/225* (2013.01); *F04B 49/24* (2013.01); *F04D 9/004* (2013.01); *F04D 9/005* (2013.01); *F04D 9/007* (2013.01); *F04D 9/02* (2013.01); *F04D 13/12* (2013.01); *F04D 15/0005* (2013.01); *F04D 15/0011* (2013.01); *F04D 15/0072* (2013.01); *F04D 27/001* (2013.01); *F04D 27/009* (2013.01); *F04D 27/02* (2013.01); *F04D 27/0215* (2013.01)

(58) Field of Classification Search
CPC .... F04D 27/0207; F04D 27/001; F04D 13/12; F04D 15/0072; F04D 27/02; F04D 27/009; F04D 15/0011; F04D 9/02; F04D 15/0005; F04D 27/0215; F04D 9/005; F04D 9/004; F04D 9/007; F04B 49/24; F04B 49/035; F04B 49/225; F04B 49/02; F04B 49/06
See application file for complete search history.

(56) References Cited

U.S. PATENT DOCUMENTS

| | | | | |
|---|---|---|---|---|
| 5,492,556 A * | 2/1996 | Garrett | B01D 53/263 95/193 |
| 6,053,702 A * | 4/2000 | Sears | F04D 15/0209 417/62 |
| 10,655,308 B2 * | 5/2020 | Smith | E03B 7/075 |

* cited by examiner

*Primary Examiner* — Peter J Bertheaud
(74) *Attorney, Agent, or Firm* — Dorsey & Whitney LLP

(57) ABSTRACT

A system for maintaining a prime of a pump includes a suction line, a discharge line, a pump line, a bypass line, and a pressure tank connected to the bypass line. The pump line includes a pump, an inlet in communication with the suction line, and a discharge in communication with the discharge line. The pump is operable to propel fluid from the suction line to the discharge line through the pump line. The bypass line extends from the suction line to the discharge line. The bypass line includes a control valve operable to selectively permit fluid to flow through the bypass line from the discharge line to the suction line.

19 Claims, 3 Drawing Sheets

SYSTEMS AND METHODS FOR MAINTAINING THE PRIME OF A PUMP

FIELD OF THE DISCLOSURE

The embodiments described herein relate generally to pumping of fluids. More specifically, the embodiments described herein relate to systems and methods for maintaining the prime of a pump and detecting leaks within a system.

BACKGROUND

Description of the Related Art

Known pumping systems may utilize a vacuum-assisted self-priming with a sensor for detecting successful priming of a pump or the loss of a prime. If a prime is lost, the pumping system may be inactivated in order to prevent a dry-run condition, which can damage pump seals. In pump systems that lift water on the suction side (suction-lift pump), known systems may frequently lose prime when the pump transitions to an idle state due to leaks in the foot valve or suction fittings. Known priming solutions activate a vacuum pump when a wet switch signals dry. However, these wet switches often malfunction and may fail to prevent air intrusion into the pump suction, thereby leading to air entrainment, which may damage pump seals. Other problems and disadvantages of known pumping systems may exist.

SUMMARY

The present disclosure is directed to systems and methods that overcome or mitigate at least some of the problems and disadvantages discussed above.

An embodiment of a system for maintaining a prime of a pump includes a suction line, a discharge line, a pump line, a bypass line, and a pressure tank connected to the bypass line. The suction line has a suction connector. The discharge line has a discharge connector. The pump line includes a pump, an inlet in communication with the suction line, and a discharge in communication with the discharge line. The pump is operable to propel fluid from the suction line to the discharge line through the pump line. The bypass line extends from the suction connector to the discharge connector. The bypass line includes a control valve operable to selectively permit fluid to flow through the bypass line from the discharge line to the suction line.

The system may include a controller operable to selectively actuate the control valve between an open position and a closed position. The open position permits a flow of fluid from the discharge line to the suction line. The closed position prevents the flow of fluid from the discharge line to the suction line.

The system may include a flow meter positioned between the suction line and the control valve. The controller may be configured to generate an alert if an aggregate volume of fluid flowing through the flow meter exceeds a preselected threshold.

The system may include a pressure-reducing valve positioned between the suction line and the control valve. The system may include a pressure gage. The system may include an inline filter positioned between the discharge line and the control valve. The system may include a first isolation valve positioned between the control valve and the discharge line and a second isolation valve positioned between the control valve and the suction line.

The system may include a junction having a first port, a second port, and a third port. The first port may be connected to the discharge connector. The second port may be connected to the pressure tank. The third port may be connected to the control valve.

An embodiment of a system for maintaining a prime of a pump includes a bypass line and a controller. The bypass line includes a first end configured to connect to a discharge line of a pump, a second end configured to connect to a suction line of the pump, and a control valve operable to selectively permit fluid to flow from the discharge line to the suction line. The controller is configured to actuate the control valve from a closed position to an open position to permit fluid to flow from the discharge line to the suction line when operation of the pump is retired in order to maintain a prime on the pump.

The system may include a pressure tank connected to the bypass line. The system may include a flow meter positioned between the second end and the control valve. The system may include a pressure gauge positioned between the second end and the control valve. The system may include a pressure-reducing valve. The flow meter may be positioned between the second end and the pressure-reducing valve. The system may include an inline filter positioned between the first end and the control valve.

An embodiment of a method of maintaining a prime of a pump includes providing a bypass line extending from a suction line to a discharge line. The bypass line includes a control valve operable to selectively permit fluid to flow through the bypass line from the discharge line to the suction line. The method includes providing a pressure tank that is in fluid communication with the bypass line and the discharge line. The method includes operating a pump to flow a fluid through a pump line at a first discharge pressure while the control valve of the bypass line is in a closed position. The closed position prevents the flow of fluid from the discharge line to the suction line through the bypass line. The method includes boosting the flow of fluid through the pump line to a second discharge pressure that is greater than the first discharge pressure. The method further includes stopping operation of the pump and actuating the control valve to change the control valve from the closed position to an open position so that a flow of fluid is permitted from the pressure tank in communication with the discharge line to the suction line.

The method may include measuring a volume of the flow of fluid through the bypass line and generating a first alert if an aggregate volume of fluid flowing through the bypass line exceeds a first preselected threshold. The method may include generating a second alert if the volume of the flow of fluid through the bypass line is below a second preselected threshold. The method may include measuring a change of pressure of the suction line after stopping operation of the pump and generating a third alert if the change in pressure does not increase above a third preselected threshold.

Figure 1:
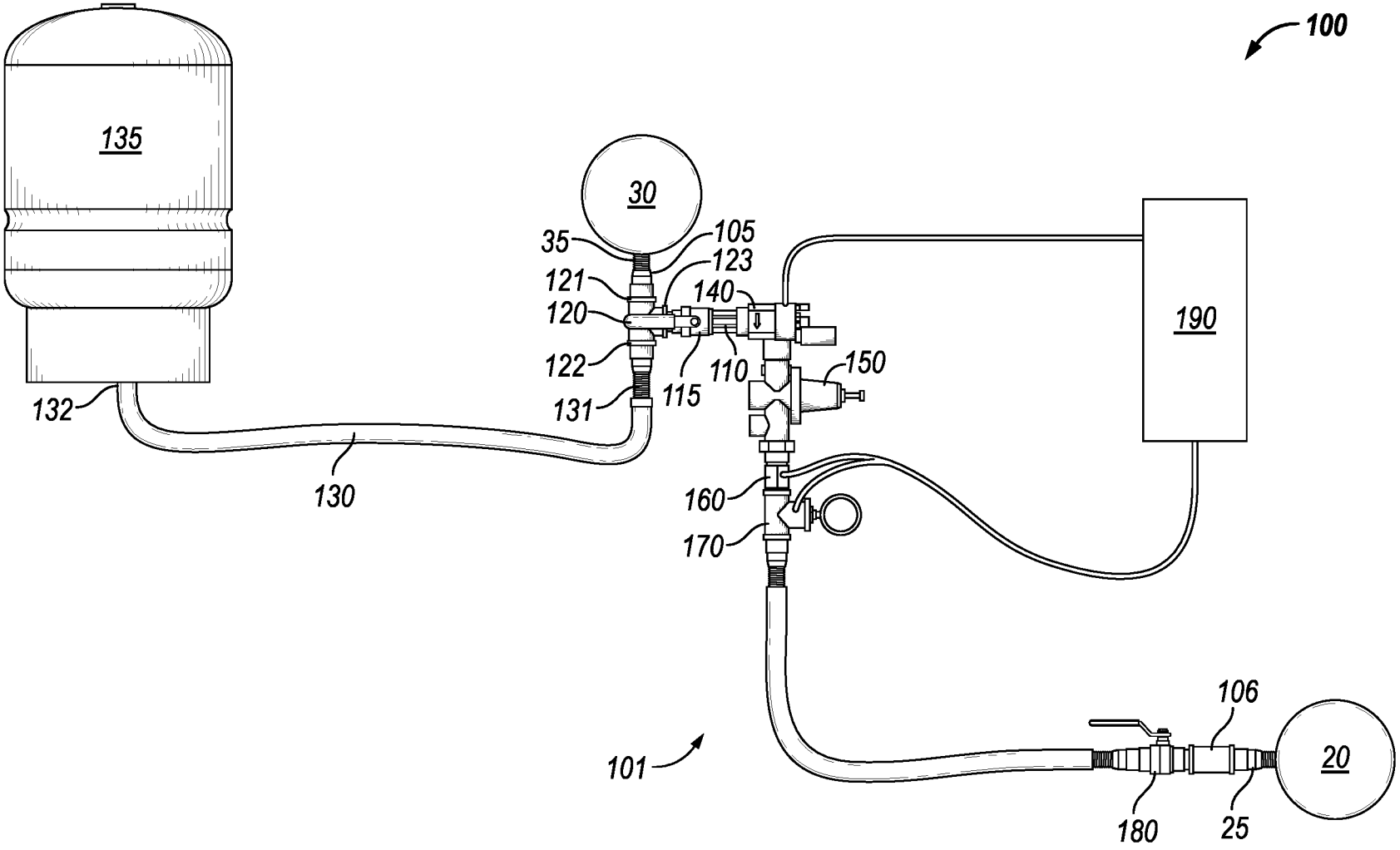
FIG. 1 shows an embodiment of a bypass line of a system for maintaining prime of a pump.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DESCRIPTION

FIG. 1 shows an embodiment of a bypass line 101 of a system 100 for maintaining prime of a pump. The system 100 includes a suction line 20, a discharge line 30, and the bypass line 101 creating a passageway for fluid from the discharge line 30 to the suction line 20. The bypass line 101 includes a first end 105 and a second end 106. The suction line 20 includes a suction connector 25 connected to the second end 106 of the bypass line 101. The discharge line 30 includes a discharge connector 35 connected to the first end 105 of the bypass line 101. The bypass line 101 is configured to selectively permit fluid to flow from the discharge line 30 at the first end 105 to the suction line 20 at the second end 106. During active operation of a pump (not shown in FIG. 1), the bypass line 101 is in a closed state so that fluid is not traveling through the bypass line 101. The system 100 includes a controller 190 configured to actuate the bypass line 101 between the closed state and an open state to selectively permit fluid to flow from the discharge line 30 to the suction line 20 so that the fluid will maintain a prime on the pump after it has retired from operation. The controller 190 may include one or more processors.

The bypass line 101 includes a junction 120 having a first port 121, a second port 122, and a third port 123. The junction 120 may be a tee fitting. The first port 121 is connected to the discharge connector 35 of the discharge line 30.

The system 100 includes a pressure tank 135. The pressure tank 135 is in fluid communication with the discharge line 30 to receive and store fluid until it is released through the bypass line 101, as described below. The pressure tank 135 may be connected to the junction 120 via an expansion branch 130. The expansion branch 130 includes a first end 131 connected to the second port 122 and a second end 132 connected to the pressure tank 135. The third port 123 is connected to a control valve 140, which selectively permits fluid communication between the discharge line 30 and the suction line 20. The control valve 140 may be a solenoid-actuated valve. The control valve 140 is operable by the controller 190 and provides feedback to the controller 190. For example, the control valve 140 provides feedback to the controller 190 to indicate whether the control valve 140 is in the open position or the closed position. The system 100 may include an inline filter 110 positioned between the discharge line 30 and the control valve 140, such as between the junction 120 and the control valve 140.

The bypass line 101 may include a pressure-reducing valve 150 positioned between the control valve 140 and the suction line 20. In some embodiments, the pressure within the discharge line 30 may exceed 100 pounds per square inch (psi) and the pressure-reducing valve 150 may reduce the pressure to less than 30 psi. For example, the suction line 20 may comprise a corrugated pipe having a pressure rating of less than 30 psi.

The bypass line 101 may include a flow meter 160, such as a vortex flow meter, and a pressure gauge 170. The flow meter 160 and pressure gauge 170 are positioned between the suction line 20 and the control valve 140. The flow meter 160 and the pressure gauge 170 provide feedback to the controller 190 to indicate the pressure at the intake of the pump (i.e. in the suction line 20) and at least one of the flow rate or the aggregate flow volume passing through the flow meter 160.

The system 100 may include a first isolation valve 115, such as a ball valve, and a second isolation valve 180 positioned to isolate the bypass line 101, or portions thereof, for maintenance. The first isolation valve 115 is positioned between the control valve 140 and the discharge line 30 and the second isolation valve 180 is positioned between the control valve 140 and the suction line 20.

Figure 2:
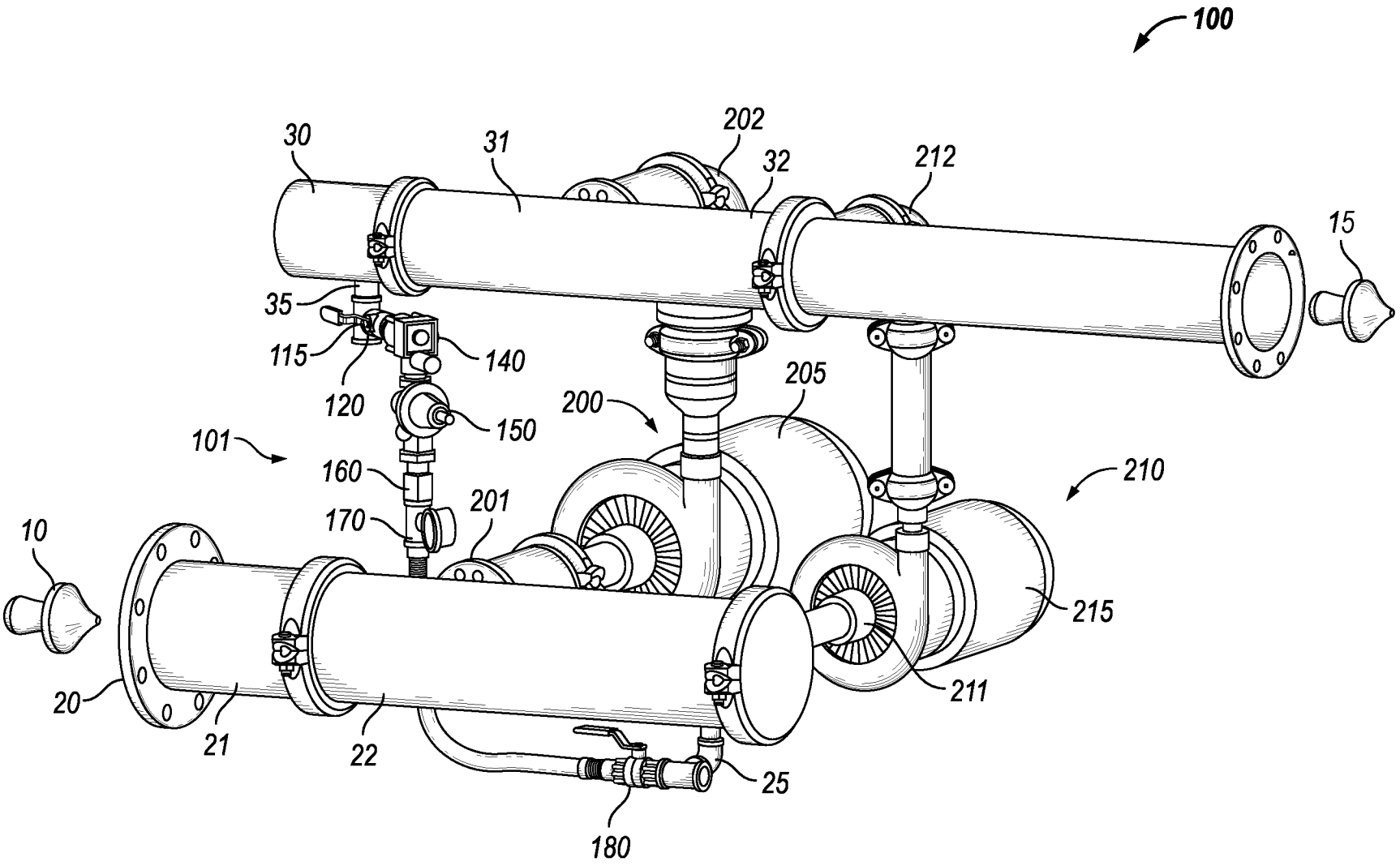
FIG. 2 shows an embodiment of a system for maintaining prime of a pump.

FIG. 2 shows the bypass line 101 installed as part of the system 100 for maintaining prime of a pump. The bypass line 101 is connected to the suction connector 25 of the suction line 20 and the discharge connector 35 of the discharge line 30. The system 100 shown in FIG. 2 includes a first pump line 200 and a second pump line 210. Persons skilled in the art having the benefit of this disclosure would understand that the bypass line 101 may be used in systems having various numbers of pumps. The first pump line 200 includes a first pump 205, a first inlet 201 in fluid communication with a first portion 21 of the suction line 20, and a first discharge 202 in fluid communication with a first portion 31 of the discharge line 30. The second pump line 210 includes a second pump 215, a second inlet 211 in fluid communication with a second portion 22 of the suction line 20, and a second discharge 212 in fluid communication with a second portion 32 of the discharge line 30.

The first pump 205 may have a greater power rating than the second pump 215. During initial operation, both the first pump 205 and the second pump 215 may be operated until a desired discharge flow 15 is achieved and then the first pump 205 may be shut down while the second pump 215 maintains a desired discharge pressure through the second pump line 210. Fluid is propelled through the first pump line 200 and/or the second pump line 210 from the suction line 20 to the discharge line 30. While the pumps 205, 215 are operating, the control valve 140 of the bypass line 101 is in a closed position so that fluid does not pass from the discharge line 30 to the suction line 20. For purposes of illustration in FIG. 2, the pressure tank 135 (shown in FIG. 1), which would be connected to junction 120, has been omitted. As the system 100 prepares to retire the last of the operating pumps 205, 215, the system 100 changes into a pressure boost stage. During the pressure boost stage, a discharge pressure setpoint within the system is increased to enable the pressure tank 135 to store more fluid. For example, the initial discharge pressure may be 100 psi and be increased to 110 psi during the pressure boost stage. The additional volume of fluid stored in the pressure tank 135 may then be used to backfill through the bypass line 101 in order to maintain the prime the pumps 205, 215 and to inhibit system disturbances due to operational pressure drops. The pressure tank 135 (shown in FIG. 1) accommodates for the increase in pressure within the system 100. Once the pressure boost is completed, the last of the pumps 205, 215 is retired and the control valve 140 is actuated by the controller 190 (shown in FIG. 1) to permit fluid to flow through the bypass line 101 to the suction line 20. The fluid flows through the pressure-reducing valve 150, the flow meter 160, and the pressure gauge 170 to the suction line 20 in order to maintain a prime on the one or more pumps 205, 215. If maintenance is needed on a portion of the bypass line 101, such as the control valve 140, the first isolation valve 115 and the second isolation valve 180 may each be closed in order to permit maintenance operations to be performed.

When the pumps 205, 215 are idle, the fluid that is passed through the bypass line 101 displaces air within the suction line 20 and creates positive pressure (rather than vacuum pressure) on the suction side of the pumps 205, 215. When it is desired to restore operation of one or more of the pumps 205, 215, the fluid that has backfilled through the bypass line 101 will then flow through the pump lines 200, 210.

Figure 3:
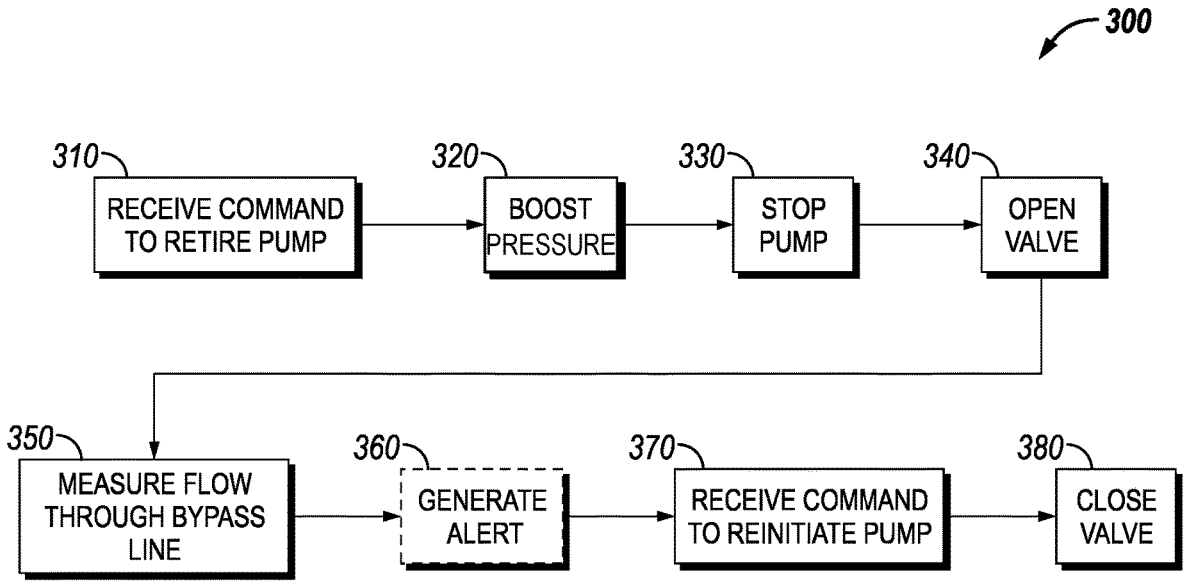
FIG. 3 shows an embodiment of a method of maintaining prime of a pump.

FIG. 3 shows an embodiment of a method 300 of maintaining a prime of a pump. The method 300 include step 310 where a command is received to retire the pump. When the command is received, a controller modifies operation of the pump to temporarily boost the discharge pressure in step 320. Once the boosting of the discharge pressure is complete, the method 300 includes stopping the pump in step 330 and opening the valve of the bypass line in step 340 so that the boosted fluid may be returned through the bypass line to the suction line. The flow of fluid to the suction line assists with maintaining a prime on the pump. The flow of fluid through the bypass line is measured in step 350 and, if the aggregate flow of fluid through the bypass line exceeds a preselected threshold, then an alert is generated in step 360 to indicate a leak in the suction side of the system. The method 300 includes receiving a command in step 370 to reinitiate operation of the pump. When the command is received, the controller causes the valve of the bypass line to close in step 380.

Figure 4:
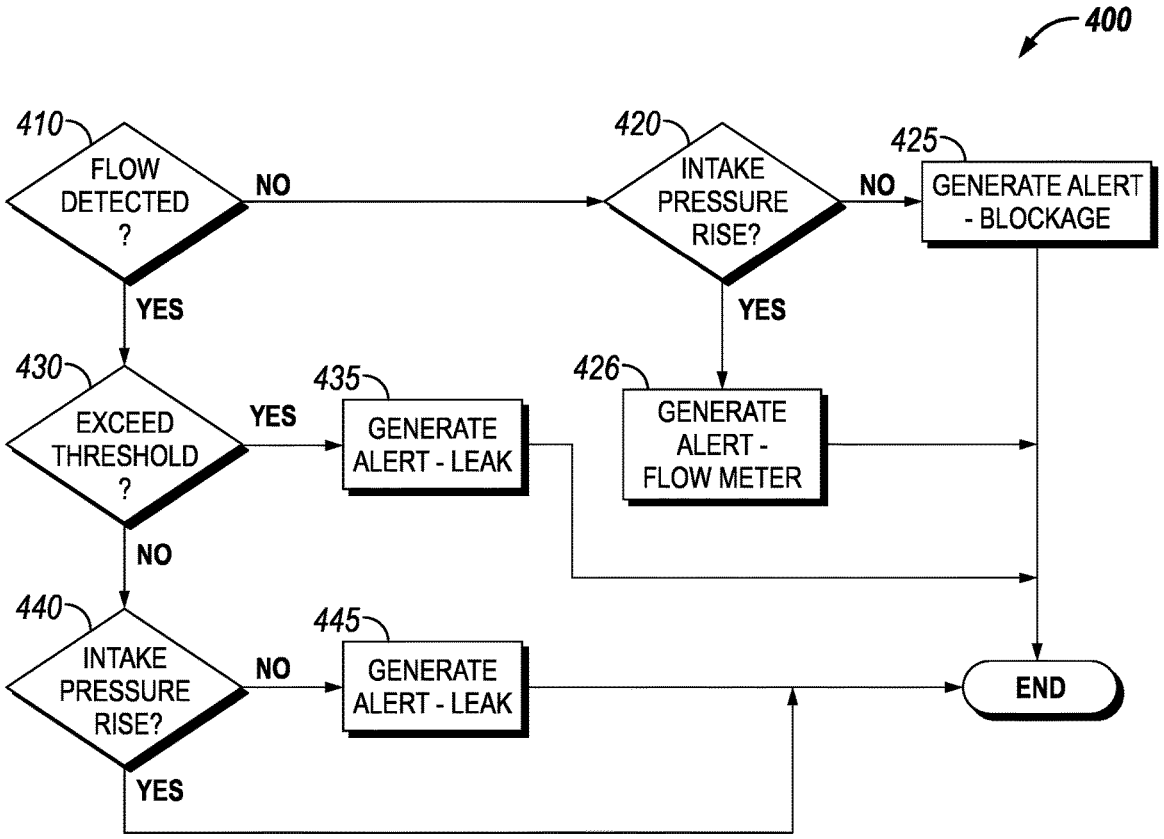
FIG. 4 shows an embodiment of a method of analyzing a flow of fluid to detect a leak.

FIG. 4 shows an embodiment of a method 400 of analyzing a flow of fluid to detect a leak. If there is a leak on the suction side of the system, the size of the leak is quantified so that an operator may determine if maintenance is necessary. Method 400 may be used in place of step 360 of method 300 shown in FIG. 3. The method includes step 410 of determining whether a flow of fluid through the bypass line was detected. If no flow was detected, or if the flow is below a preselected threshold, the method 400 proceeds to step 420 to determine whether there was a pressure increase at the intake (suction line) of the system. In some embodiments, step 420 may determine if the pressure increase at the intake was below a preselected threshold. In some embodiments, the preselected thresholds may be no flow and/or no rise in intake pressure. If no flow was detected and no rise in intake pressure was detected, then method 400 includes generating an alert indicating a blockage at step 425. As used herein, generating an alert may include displaying the alert on a control panel and/or transmitting the alert to a remote location, such as to a mobile phone. If no flow was detected, but a rise in intake pressure was detected, then method 400 includes generating an alert indicating a problem with the flow meter at step 426. The method 400 is then concluded until the bypass line is again cycled between the closed state and the open state.

If, during step 410, flow is detected, then method 400 includes step 430 to determine whether the aggregate volume of fluid flowing through the flow meter exceeds a preselected threshold. If the flow exceeds the preselected threshold, then method 400 includes generating an alert indicating a leak at step 435.

If the flow does not exceed the preselected threshold, then method 400 includes step 440 to determine whether there was a pressure increase at the intake (suction line) of the system. If a rise in intake pressure was detected, then no alert is generated. If the flow does not exceed the preselected threshold and no rise in intake pressure was detected, then method 400 includes generating an alert indicating a leak at step 445.

Although this disclosure has been described in terms of certain preferred embodiments, other embodiments that are apparent to those of ordinary skill in the art, including embodiments that do not provide all of the features and advantages set forth herein, are also within the scope of this disclosure.

What is claimed is:

1. A system for maintaining a prime of a suction lift pump, the system comprising:

a suction line having a suction connector;

a discharge line having a discharge connector;

a pump line including a pump, an inlet in communication with the suction line, and a discharge in communication with the discharge line, the pump operable to place vacuum pressure on the suction line and propel fluid from the suction line to the discharge line through the pump line;

a bypass line extending from the suction connector to the discharge connector, the bypass line including a control valve operable to selectively permit fluid to flow through the bypass line from the discharge line on a first side of the control valve to the suction line on a second side of the control valve;

a controller operable to selectively actuate the control valve between an open position when the pump is not operating and a closed position during operation of the pump, the closed position prevents the flow of fluid from the discharge line to the suction line, the open position permits a flow of fluid from the discharge line to the suction line; and a pressure tank in fluid communication with the bypass line, the pressure tank positioned on the first side of the control valve.

2. The system of claim 1, wherein the bypass line further comprises a flow meter positioned between the suction line and the control valve.

3. The system of claim 2, wherein the controller is configured to generate an alert if an aggregate volume of fluid flowing through the flow meter exceeds a preselected threshold.

4. The system of claim 2, wherein the bypass line further comprises a pressure-reducing valve positioned between the suction line and the control valve.

5. The system of claim 4, wherein the bypass line further comprises a pressure guage.

6. The system of claim 2, wherein the bypass line further comprises a pressure guage.

7. The system of claim 2, wherein the bypass line further comprises an inline filter positioned between the discharge line and the control valve.

8. The system of claim 1, further comprising a first isolation valve positioned between the control valve and the discharge line and a second isolation valve positioned between the control valve and the suction line.

9. The system of claim 1, further comprising a junction having a first port, a second port, and a third port, the first port connected to the discharge connector, the second port connected to the pressure tank, and the third port connected to the control valve.

10. A system for maintaining a prime of a pump, the system comprising:

a bypass line including a first end configured to connect to a discharge line of a pump;

a second end configured to connect to a suction line of the pump; and a control valve operable to selectively permit fluid to flow from the discharge line on a first side of the control valve to the suction line on a second side of the control valve; and a controller configured to actuate the control valve from a closed position during operation of the pump to an open position to permit fluid to flow from the discharge line to the suction line when operation of the pump is retired in order to maintain a prime on the pump.

11. The system of claim 10, further comprising a pressure tank in fluid communication with the bypass line, the pressure tank positioned on the first side of the control valve.

12. The system of claim 11, wherein the bypass line further comprises a flow meter positioned between the second end and the control valve.

13. The system of claim 12, wherein the bypass line further comprises a pressure guage positioned between the second end and the control valve.

14. The system of claim 12, wherein the bypass line further comprises a pressure-reducing valve, the flow meter positioned between the second end and the pressure-reducing valve.

15. The system of claim 12, further comprising an inline filter positioned between the first end and the control valve.

16. A method of maintaining a prime of a pump, the method comprising:

providing a bypass line extending from a suction line to a discharge line, the bypass line including a control valve operable to selectively permit fluid to flow through the bypass line from the discharge line on a first side of the control valve to the suction line on a second side of the control valve;

providing a pressure tank in fluid communication with the bypass line and the discharge line, the pressure tank positioned on the first side of the control valve;

operating a pump to flow a fluid through a pump line at a discharge pressure setpoint while the control valve of the bypass line is in a closed position, the closed position preventing the flow of fluid from the discharge line to the suction line through the bypass line;

receiving a command to retire the pump;

modifying operation of the pump in response to the command by boosting the discharge pressure setpoint, thereby increasing pressure in the pressure tank;

stopping operation of the pump after boosting the discharge pressure setpoint; and actuating the control valve after boosting the discharge pressure setpoint to change the control valve from the closed position to an open position, the open position permitting a flow of fluid to the suction line, wherein fluid within the pressure tank flows through the bypass line and creates positive pressure on the suction line.

17. The method of claim 16, further comprising:

measuring a volume of the flow of fluid through the bypass line; and generating a first alert if an aggregate volume of fluid flowing through the bypass line exceeds a first preselected threshold.

18. The method of claim 17, further comprising generating a second alert if the volume of the flow of fluid through the bypass line is below a second preselected threshold.

19. The method of claim 18, further comprising:

measuring a change of pressure of the suction line after stopping operation of the pump; and generating a third alert if the change in pressure does not increase above a third preselected threshold.

* * * * *